US005963899A

United States Patent [19]

Bayya et al.

[11] Patent Number: 5,963,899

[45] **Date of Patent: *Oct. 5, 1999**

[54] METHOD AND SYSTEM FOR REGION BASED FILTERING OF SPEECH

[75] Inventors: Aruna Bayya, Irvine, Calif.; Marvin L. Vis, Longmont, Colo.

[73] Assignees: U S West, Inc., Denver; MediaOne Group, Inc., Englewood, both of Colo.

[ * ] Notice: This patent is subject to a terminal disclaimer.

[21] Appl. No.: 08/694,654

[22] Filed: Aug. 7, 1996

[51] Int. Cl.[6] ..... G10L 3/02

[52] U.S. Cl. ..... 704/226; 704/233

[58] Field of Search ..... 364/724.011; 704/214–215, 704/206, 208, 210, 233, 226, 227, 202, 232, 254, 500, 503

[56] References Cited

U.S. PATENT DOCUMENTS

| | | | |
|---|---|---|---|
| 3,679,830 | 7/1972 | Uffelman et al. | 704/215 |
| 3,803,357 | 4/1974 | Sacks . | |
| 3,976,863 | 8/1976 | Engel | 364/724.011 |
| 4,052,559 | 10/1977 | Paul et al. | 333/166 |
| 4,177,430 | 12/1979 | Paul . | |
| 4,630,305 | 12/1986 | Borth et al. . | |
| 4,658,426 | 4/1987 | Chabries et al. . | |

(List continued on next page.)

OTHER PUBLICATIONS

Hynek Hermansky, et al., "Noise Suppression in Cellular Communications", Interactive Voice Technology for Telecommunications Applications, 1994 Workshop, IEEE/IEE Publications Ondisc, pp. 85–88.

Joachim Koehler, et al "Integrating Rasta–PLP Into Speech Recognition", ICASSP '94 Acoustics, Speech & Signal Processing Conference, vol. I, 1994, IEEE/IEE Publications Ondisc, pp. I–421–I–424.

John B. Allen, "Short Term Spectral Analysis, Synthesis, and Modification by Discrete Fourier Transf.", IEEE Tr. on Acc., Spe. & Signal Proc., vol. ASSP–25, No. 3, Jun. 1997, pp. 235–238.

"Signal Estimation from Modified Short–Term Fourier Transform," IEEE Trans. on Accou. Speech and Signal Processing, vol. ASSP–32, No. 2, Apr., 1984, Griffin et al., pp. 236–243.

Simon Haykin, "Neural Works—A Comprehensive Foundation," 1994, pp. 138–156.

K. Sam Shanmugan, "Random Signals: Detection, Estimation and Data Analysis," 1988, pp. 407–448.

H. Kwakernaak, R. Sivan, and R. Strijbos, "Modern Signals and Systems," pp. 314 and 531, 1991.

M. Sambur, "Adaptive Noise Canceling For Speech Signals," *IEEE Trans. ASSP,* vol. 26, No. 5, pp. 419–423, Oct., 1978.

U. Ephraim and H.L. Van Trees, "A Signal Subspace Approach For Speech Enhancement," *IEEE Proc. ICASSP,* vol. 11, pp. 355–358, 1993.

Y. Ephraim and H.L. Van Trees, "A Spectrally–Based Signal Subspace Approach For Speech Enhancement," *IEEE ICASSP Proceedings,* pp. 804–807, 1995.

S. F. Boll, "Suppression Of Acoustic Noise In Speech Using Spectral Subtraction," *Proc. IEEE ASSP,* vol. 27, No. 2, pp. 113–120, Apr., 1979.

G.S. Kang and L.J. Fransen, "Quality Improvement of LPC–Processed Noisy Speech By Using Spectral Subtraction," *IEEE Trans. ASSP* 37:6, pp. 939–942, Jun. 1989.

(List continued on next page.)

*Primary Examiner*—David D. Knepper
*Attorney, Agent, or Firm*—Brooks & Kushman, P.C.

[57] ABSTRACT

A speech signal divided into frames, each frame having a sound type, and a class is determined for each frame depending on the sound type of the frame. One of multiple filters is selected for each frame depending on the class of the frame. Each frame is filtered according to the filter selected, and the filtered frames combined to provide a filtered speech signal. The system includes filters and software.

18 Claims, 2 Drawing Sheets

U.S. PATENT DOCUMENTS

| | | | |
|---|---|---|---|
| 4,701,953 | 10/1987 | White . | |
| 4,737,976 | 4/1988 | Borth et al. | 455/563 |
| 4,747,143 | 5/1988 | Kroeger et al. . | |
| 4,761,829 | 8/1988 | Lynk, Jr. et al. . | |
| 4,799,179 | 1/1989 | Masson et al. . | |
| 4,811,404 | 3/1989 | Vilmur et al. . | |
| 4,897,878 | 1/1990 | Boll et al. . | |
| 4,937,869 | 6/1990 | Iwahashi et al. | 704/254 |
| 4,937,873 | 6/1990 | McAulay et al. | 704/265 |
| 4,942,607 | 7/1990 | Schroder et al. . | |
| 5,008,939 | 4/1991 | Bose et al. . | |
| 5,012,519 | 4/1991 | Adlersberg et al. . | |
| 5,054,072 | 10/1991 | McAulay et al. . | |
| 5,097,510 | 3/1992 | Graupe . | |
| 5,148,488 | 9/1992 | Chen et al. . | |
| 5,185,848 | 2/1993 | Aritsuka et al. . | |
| 5,214,708 | 5/1993 | McEachern . | |
| 5,253,298 | 10/1993 | Parker et al. . | |
| 5,285,165 | 2/1994 | Renfors et al. . | |
| 5,353,374 | 10/1994 | Wilson et al. . | |
| 5,394,473 | 2/1995 | Davidson . | |
| 5,396,657 | 3/1995 | Jokinen | 364/724.011 |
| 5,404,422 | 4/1995 | Sakamoto et al. | 704/232 |
| 5,406,635 | 4/1995 | Jarvinen . | |
| 5,432,859 | 7/1995 | Yang et al. . | |
| 5,434,947 | 7/1995 | Gerson et al. . | |
| 5,450,339 | 9/1995 | Chester et al. | 364/724.011 |
| 5,450,522 | 9/1995 | Hermanski et al. | 704/211 |
| 5,461,697 | 10/1995 | Nishimura et al. . | |
| 5,485,524 | 1/1996 | Kuusama et al. . | |
| 5,524,148 | 6/1996 | Allen et al. . | |
| 5,537,647 | 7/1996 | Hermansky et al. . | |
| 5,577,161 | 11/1996 | Palaez Ferrigno . | |
| 5,586,215 | 12/1996 | Stork et al. . | |
| 5,590,241 | 12/1996 | Park et al. . | |
| 5,661,822 | 8/1997 | Knowles et al. . | |

OTHER PUBLICATIONS

M. Viberg and B. Ottersten, "Sensor Array Processing Based On Subspace Fitting," *IEEE Trans. ASSP,* 39:5, pp. 1110–1121, May, 1991.

L. L. Scharf, "The SVD And Reduced–Rank Signal Processing," *Signal Processing* 25, pp. 113–133, Nov., 1991.

H. Hermansky and N. Morgan, "RASTA Processing Of Speech," *IEEE Trans. Speech And Audio Proc.,* 2:4, pp. 578–589, Oct., 1994.

H. Hermansky, E.A. Wan and C. Avendano, "Speech Enhancement Based On Temporal Processing," IEEE ICASSP Conference Proceedings, pp. 405–408, Detroit, Michigan, 1995.

D. L. Wang and J. S. Lim, "The Unimportance Of Phase In Speech Enhancement," *IEEE Trans. ASSP,* vol. ASSP–30, No. 4, pp. 679–681, Aug., 1982.

H. G. Hirsch, "Estimation Of Noise Spectrum And Its Application To SNR–Estimation And Speech Enhancement,", *Technical Report,* Intern'l Computer Science Institute, pp. 1–32.

A. Kundu, "Motion Estimation By Image Content Matching And Application To Video Processing," to be published *ICASSP,* 1996, Atlanta, GA.

Harris Ducker, "Speech Processing In A High Ambient Noise Environment," *IEEE Trans. Audio and Electroacoustics,* vol. 16, No. 2, pp. 165–168, Jun., 1968.

METHOD AND SYSTEM FOR REGION BASED FILTERING OF SPEECH

RELATED APPLICATION

This application is related to U.S. patent application ser. No. 08/695,097, which was filed on the same date and assigned to the same assignee as the present application.

TECHNICAL FIELD

This invention relates to an adaptive method and system for filtering speech signals.

BACKGROUND ART

In wireless communications, background noise and static can be annoying in speaker to speaker conversation and a hindrance in speaker to machine recognition. As a result, noise suppression is an important part of the enhancement of speech signals recorded over wireless channels in mobile environments.

In that regard, a variety of noise suppression techniques have been developed. Such techniques typically operate on single microphone, output-based speech samples which originate in a variety of noisy environments, where it is assumed that the noise component of the signal is additive with unknown coloration and variance.

One such technique is Least Mean-Squared (LMS) Predictive Noise Cancelling. In this technique it is assumed that the additive noise is not predictable, whereas the speech component is predictable. LMS weights are adapted to the time series of the signal to produce a time-varying matched filter for the predictable speech component such that the mean-squared error (MSE) is minimized. The estimated clean speech signal is then the filtered version of the time series.

However, the structure of speech in the time domain is neither coherent nor stationary enough for this technique to be effective. A trade-off is therefore required between fast settling time, good tracking ability and the ability to track everything (including noise). This technique also has difficulty with relatively unstructured non-voiced segments of speech.

Another noise suppression technique is Signal Subspace (SSP) filtering (which here includes Spectral Subtraction (SS)). SSP is essentially a weighted subspace fitting applied to speech signals, or a set of bandpass filters whose outputs are linearly weighted and combined. SS involves estimating the (additive) noise magnitude spectrum, typically done during non-speech segments of data, and subtracting this spectrum from the noisy speech magnitude spectrum to obtain an estimate of the clean speech spectrum. If the resulting spectral estimate is negative, it is rectified to a small positive value. This estimated magnitude spectrum is then combined with the phase information from the noisy signal and used to construct an estimate of the clean speech signal.

SSP assumes the speech signal is well-approximated by a sum of sinusoids. However, speech signals are rarely simply sums of undamped sinusoids and can, in many common cases, exhibit stochastic qualities (e.g., unvoiced fricatives). SSP relies on the concept of bias-variance trade-off. For channels having a Signal-to-Noise Ratio (SNR) less than 0 dB, some bias is permitted to give up a larger dosage of variance and obtain a lower overall MSE. In the speech case, the channel bias is the clean speech component, and the channel variance is the noise component. However, SSP does not deal well with channels having SNR greater than zero.

In addition, SS is undesirable unless the SNR of the associated channel is less than 0 dB (i.e., unless the noise component is larger than the signal component). For this reason, the ability of SS to improve speech quality is restricted to speech masked by narrowband noise. SS is best viewed as an adaptive notch filter which is not well applicable to wideband noise.

Still another noise suppression technique is Wiener filtering, which can take many forms including a statistics-based channel equalizer. In this context, the time domain signal is filtered in an attempt to compensate for non-uniform frequency response in the voice channel. Typically, this filter is designed using a set of noisy speech signals and the corresponding clean signals. Taps are adjusted to optimally predict the clean sequence from the noisy one according to some error measure. Once again, however, the structure of speech in the time domain is neither coherent nor stationary enough for this technique to be effective.

Yet another noise suppression technique is Relative Spectral speech processing (RASTA). In this technique, multiple filters are designed or trained for filtering spectral subbands. First, the signal is decomposed into N spectral subbands (currently, Discrete Fourier Transform vectors are used to define the subband filters). The magnitude spectrum is then filtered with N/2+1 linear or non-linear neural-net subband filters.

However, the characteristics of the complex transformed signal (spectrum) have been elusive. As a result, RASTA subband filtering has been performed on the magnitude spectrum only, using the noisy phase for reconstruction. However, an accurate estimate of phase information gives little, if any, noticeable improvement in speech quality.

The dynamic nature of noise sources and the non-stationery nature of speech ideally call for adaptive techniques to improve the quality of speech. Most of the existing noise suppression techniques discussed above, however, are not adaptive. Such adaptation can be performed in various dimensions and at various levels. One type of adaptation where importance is given to noise characteristics and level is based on level of noise and level of distortion in a speech signal. However, for a given noise level, adaptation can also be done based on speech characteristics. The best solution being adaptation based simultaneously on noise characteristics as well as speech characteristics While some recently proposed techniques are designed to adapt to the noise level or SNR, none take into account the non-stationary nature of speech and try to adapt to different sound categories.

An article by Harris Ducker entitled "Speech Processing in a high ambient noise environment", *IEEE Trans. Audio and Electroacoustics*, Vol. 16, No. 2, June, 1968, pp. 165–168, discusses the effect of noise on different speech sounds and the resulting confusion among sound categories. While a high-pass filter is employed in an effort to resolve this confusion, such a filter is only used for some sound categories. Moreover, the classification of sound in this technique is only done manually by experiment.

Thus, there exists a need for a noise suppression technique which would automatically classify sounds and apply an appropriate filter for each class. Moreover, such a technique would use filtering that adapts to speech sounds.

DISCLOSURE OF INVENTION

Accordingly, it is the principle object of the present invention to provide an improved method and system for filtering speech signals.

According to the present invention, then, a method and system are provided for adaptively filtering a speech signal.

The method comprises dividing the signal into a plurality of frames, each frame having one of a plurality of sound types associated therewith, and determining one of a plurality of classes for each frame, wherein the class determined depends on the sound type associated with the frame. The method further comprises selecting one of a plurality of filters for each frame, wherein the filter selected depends on the class of the frame, and filtering each frame according to the filter selected. The method still further comprises combining the plurality of filtered frames to provide a filtered speech signal.

The system of the present invention for adaptively filtering a speech signal comprises means for dividing the signal into a plurality of frames, each frame having one of a plurality of sound types associated therewith, and means for determining one of a plurality of classes for each frame, wherein the class determined depends on the sound type associated with the frame. The system further comprises a plurality of filters for filtering the frames, and means for selecting one of the plurality of filters for each frame, wherein the filter selected depends upon the class of the frame. The system still further comprises means for combining the plurality of filtered frames to provide a filtered speech signal.

These and other objects, features and advantages will be readily apparent upon consideration of the following detailed description in conjunction with the accompanying drawings.

BEST MODE FOR CARRYING OUT THE INVENTION

Figure 1A:
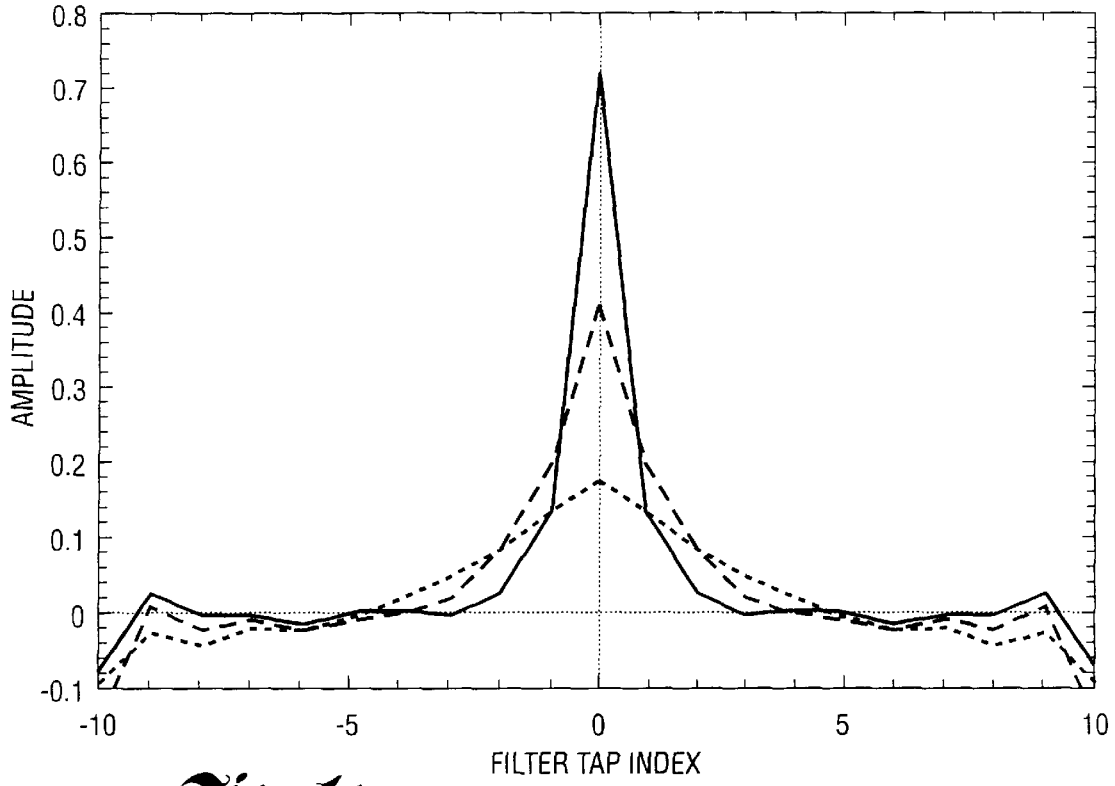
FIG. 1*a–b* are plots of filterbanks trained at Signal-to-Noise Ratio values of 0, 10, 20 dB at subbands centered around 800 Hz and 2200 Hz, respectively.

Improving the quality of speech signals in the presence of noise requires understanding the characteristics of the noise source as well as its effects on the speech signal at various levels and on different regions of the speech signal. However, it is not feasible to obtain enough samples to study all possible noise sources.

Traditionally, the Wiener filtering techniques discussed above have been packaged as a channel equalizer or spectrum shaper for a sequence of random variables. However, the subband filters of the RASTA form of Wiener filtering can more properly be viewed as Minimum Mean-squared Error Estimators (MMSEE) which predict the clean speech spectrum for a given channel by filtering the noisy spectrum, where the filters are pre-determined by training them with respect to MSE on pairs of noisy and clean speech samples.

In that regard, original versions of RASTA subband filters consisted of heuristic Autoregressive Moving Average (ARMA) filters which operated on the compressed magnitude spectrum. The parameters for these filters were designed to provide an approximate matched filter for the speech component of noisy compressed magnitude spectrums and were obtained using clean speech spectra examples as models of typical speech Later versions used Finite Impulse Response (FIR) filterbanks which were trained by solving a simple least squares prediction problem, where the FIR filters predicted known clean speech spectra from noisy realizations of it.

Assuming that the training samples (clean and noisy) are representative of typical speech samples and that speech sequences are approximately stationary across the sample, it can be seen that a MMSEE is provided for speech magnitude spectra from noisy speech samples. In the case of FIR filterbanks, this is actually a Linear MMSEE of the compressed magnitude spectrum. This discussion can, however, be extended to include non-linear predictors as well. As a result, the term MMSEE will be used, even as reference is made to LMMSEE.

There are, however, two problems with the above assumptions. First, the training samples cannot be representative of all noise colorations and SNR levels. Second, speech is not a stationary process Nevertheless, MMSEE may be improved by changing those assumptions and creating an adaptive subband Wiener filter which minimizes MSE using specialized filterbanks according to speech region and noise levels.

In that regard, the design of subband FIR filters is subject to a MSE criterion. That is, each subband filter is chosen such that it minimizes squared error in predicting the clean speech spectra from the noisy speech spectra. This squared error contains two components i) signal distortion (bias); and ii) noise variance. Hence a bias-variance tradeoff is again seen for minimizing overall MSE. This trade-off produces filterbanks which are highly dependent on noise variance. For example, if the SNR of a "noisy" sample were infinite, the subband filters would all be simply $\delta_k$, where $$\delta_k = \begin{cases} 1, k = 0 \\ 0, o.w. \end{cases}.$$

On the other hand, when the SNR is low, filterbanks are obtained whose energy is smeared away from zero. This phenomenon occurs because the clean speech spectra is relatively coherent compared to the additive noise signals. Therefore, the overall squared error in the least squares (training) solution is minimized by averaging the noise component (i.e., reducing noise variance) and consequently allowing some signal distortion. If this were not true, nothing would be gained (with respect to MSE) by filtering the spectral magnitudes of noisy speech.

Figure 1B:
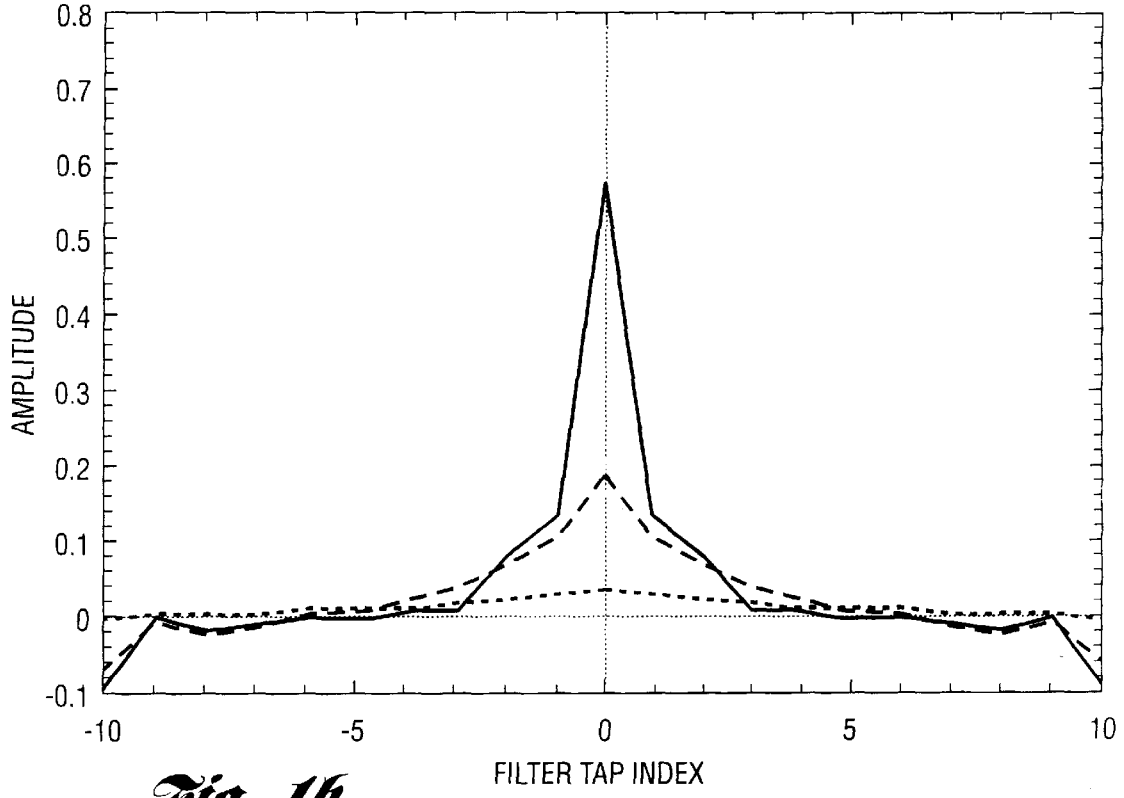

Three typical filterbanks which were trained at SNR values of 0, 10, 20 dB, respectively, are shown in FIG. 1 to illustrate this point. The first set of filters (FIG. 1*a*) correspond to the subband centered around 800 Hz, and the second (FIG. 1*b*) represent the region around 2200 Hz. The filters corresponding to lower SNR's (In FIG. 1, the filterbanks for the lower SNR levels have center taps which are similarly lower) have a strong averaging (lowpass) capability in addition to an overall reduction in gain.

With particular reference to the filterbanks used at 2200 Hz (FIG. 1*b*), this region of the spectrum is a low-point in the average spectrum of the clean training data, and hence the subband around 2200 Hz has a lower channel SNR than the overall SNR for the noisy versions of the training data. So, for example, when training with an overall SNR of 0 dB, the subband SNR for the band around 2200 Hz is less than 0 dB (i.e., there is more noise energy than signal energy). As a result, the associated filterbank, which was trained to minimize MSE, is nearly zero and effectively eliminates the channel.

Significantly, if the channel SNR cannot be brought above 0 dB by filtering the channel, overall MSE can be improved by simply zeroing the channel. To pre-determine the post-filtered SNR, three quantities are needed: i) an initial (pre-filtered) SNR estimate; ii) the expected noise reduction due to the associated subband filter; and iii) the expected (average speech signal distortion introduced by the filter. For example, if the channel SNR is estimated to be −3 dB, the associated subband filter's noise variance reduction capability at 5 dB, and the expected distortion at −1 dB, a positive post-filtering SNR is obtained and the filtering operation should be performed. Conversely, if the pre-filtering SNR was instead −5 dB, the channel should simply be zeroed.

The above discussion assumes that an estimator of subband SNR is available. This estimator must be used for the latter approach of determining the usefulness of a channel's output as well as for adaptively determining which subband filter should be used. In that regard, an SNR estimation technique well known in the art which uses the bimodal characteristic of a noisy speech sample's histogram to determine the expected values of signal and noise energy may be used. However, accurately tracking multiple (subband) SNR estimates is difficult since instantaneous SNR for speech signals is a dramatically varying quantity. Hence, the noise spectrum, which is a relatively stable quantity, may instead be tracked This estimate may then be used to predict the localized subband SNR values. The bimodal idea of the known SNR estimation technique described above may still contribute as a noise spectrum estimate.

Thus, speech distortion is allowed in exchange for reduced noise variance. This is achieved by throwing out channels whose SNR is less than 0 dB and by subband filtering the noisy magnitude spectrum. Noise averaging gives a significant reduction in noise variance, while effecting a lesser amount of speech distortion (relative to the reduction in noise variance). Subband filterbanks are chosen according to the SNR of a channel, independent of the SNR estimate of other channels, in order to adapt to a variety of noise colorations and variations in speech spectra. By specializing sets of filterbanks for various SNR levels, appropriate levels for noise variance reduction and signal distortion may be adaptively chosen according to subband SNR estimates to minimize overall MSE. In such a fashion, the problem concerning training samples which cannot be representative of all noise colorations and SNR levels is solved.

However, speech non-stationarity also poses a difficult barrier for many noise suppression techniques. Recall that one of the problems with the LMS Predictive technique is sufficiently tracking changes in the speech signal without tracking everything (including the noise component of the signal). A significant hindrance to SSP is that, while some regions (e.g. vowels) are well-approximated by a reduced rank model (that is, vowels typically exhibit peaked spectrums whose valleys represent subband areas which can be thrown out due to low subband SNR), unvoiced fricatives do not. The result of running SSP on a speech signal without regard for a region-based analysis is a processed signal whose unvoiced regions sound musical or whistle-like.

It can be empirically assumed, however, that a sequence of many speech phonemes, each from a common class (e.g. vowels or nasals), is more stationary than a typical speech sample consisting of all phonemes, such as conversational speech. The present invention uses this assumption to provide improved noise suppression and may be described as filtering of noisy speech based on the type of speech sound in the signal.

For example, to train a set of filterbanks for the class of nasals, a classifier (rough speech recognizer) is first built which detects nasal frames in the time domain and marks them. Such an classifier must be robust across noisy environments. Next, the filterbanks are trained across various noise levels as discussed above, using only those frames marked as "nasal" frames. The resulting filterbank set is then used for noise suppression whenever the region classifier indicates a nasal region. This training process would also be performed for other classes of speech such as vowels, glides, fricatives, etc.

The present invention thus provides a multi-resolution speech recognizer which uses region-based filtering to obtain finer resolution phoneme estimates within a class of phonemes. This is accomplished generally by estimating the class of phoneme, filtering with the appropriate filterbank, and performing a final phoneme detection, where the search is limited to the particular class in question (or at least weighted heavily in favor of it).

Figure 2:
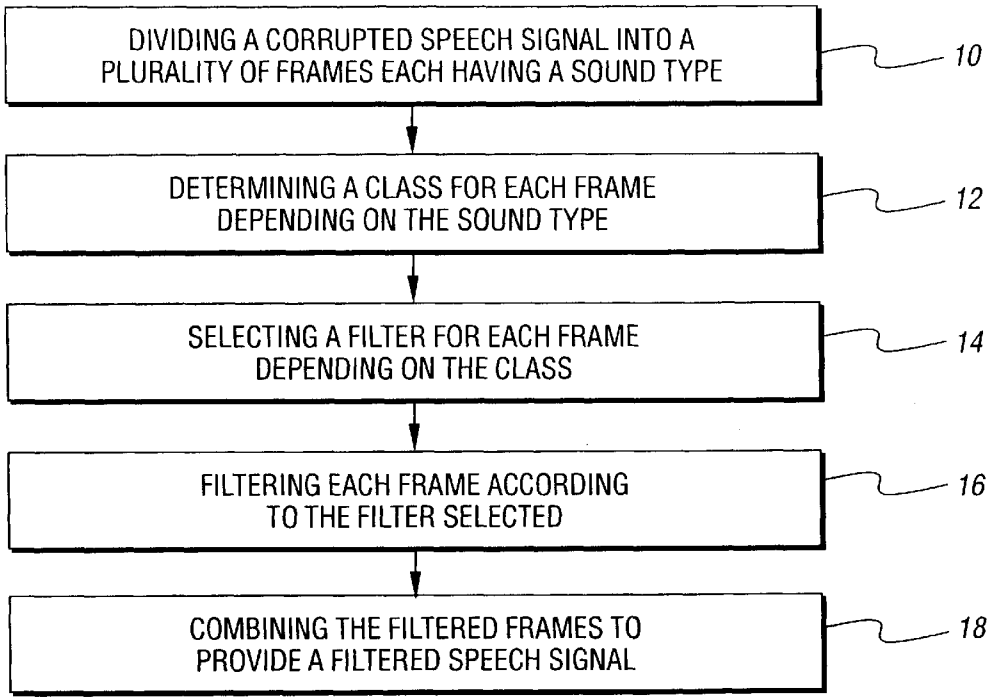
FIG. 2 is a flowchart of the method of the present invention.

Referring now to FIG. 2, a flowchart of the method of the present invention is shown. As seen therein, the method comprises dividing (10) a corrupted speech signal into a plurality of frames, each frame having one of a plurality of sound types associated therewith, and determining (12) one of a plurality of classes for each frame, wherein the class determined depends on the sound type associated with the frame. The method further comprises selecting (14) one of a plurality of filters for each frame, wherein the filter selected depends on the class of the frame, and filtering (16) each frame according to the filter selected. The method still further comprises combining (18) the plurality of filtered frames to provide a filtered speech signal.

It should be noted that the method of the present invention may include two stages. During a training stage, filter parameters are estimated for the filters based on clean speech signals. Actual filtering is performed during a noise suppression stage. A broad category classifier is used to classify each frame of speech signal into an acoustic category. Sound categories for classifying each frame preferably include silence, fricatives, stops, vowels, nasals, glides and other non-speech sounds. In the preferred embodiment, artificial neural networks are trained to perform this classification.

It should also be noted that the noisy signal is filtered across the frames using the specific filter designed for the particular speech sound category to which that frame belongs. That is, different filters are designed for each acoustic class and an appropriate filter from a filterbank is applied to each frame of speech based on the output of the classifier. The frames themselves are portions of the corrupted speech signal from the time domain and have a pre-selected period, preferably 32 msec with 75% overlap. However, frame size may also be adaptively chosen to match the class of sound type.

Figure 3:
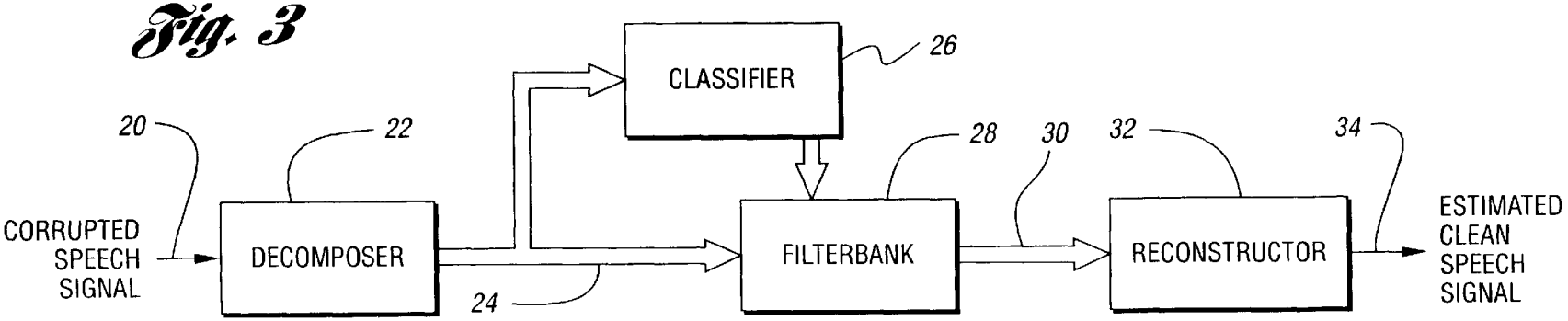
FIG. 3 is a block diagram of the system of the present invention.

Referring next to FIG. 3, a block diagram of the system of the present invention is shown. As seen therein, a corrupted speech signal (20) is transmitted to a decomposer (22). As previously discussed with respect to the method of the present invention, decomposer (22) divides speech signal (20) into a plurality of frames, each frame having one of a plurality of sound types associated therewith.

As discussed above, speech signal (20) is preferably a time domain signal. The plurality of frames are then portions of speech signal (20) having pre-selected time periods, preferably 32 msec. As also discussed above, the plurality of sound types associated with the frames preferably includes silence, fricatives, stops, vowels, nasals, glides and other non-speech sounds. A neural network is preferably used to perform the classification.

Still referring to FIG. 3, decomposer (22) generates a decomposed speech signal (24) which is transmitted to an classifier (26) and a filter bank (28). Once again, as previously discussed with respect to the method of the present invention, classifier (26) determines one of a plurality of classes for each frame, wherein the class determined depends on the sound type and noise level associated with the frame.

Depending on the class of the frame, classifier (26) also selects one of a plurality of filters from filterbank (28) for that frame. As previously discussed, the plurality of filters from filterbank (28) may be pre-trained using clean speech signals. Moreover, while any type of classifier (26) well known in the art may be used, classifier (26) preferably comprises a neural network. The parameters of the neural network are estimated by training the neural network with hand-segmented clean as well as noisy speech samples. An estimator may also determine a speech quality indicator for each class in each subband. Preferably, such a quality indicator is an estimated SNR.

After each frame is filtered at filterbank (28) according to the filter selected therefor by classifier (26), a filtered decomposed speech signal (30) is transmitted to a reconstructor (32) Reconstructor (32) then re-combines the filtered frames in order to construct an estimated clean speech signal (34) As those of ordinary skill in the art will recognize, the system of the present invention also includes appropriate software for performing the above-described functions.

As is readily apparent from the foregoing description, then, the present invention provides an improved method and system for filtering speech signals. More specifically, the present invention thus provides an adaptable method and system for noise suppression based on speech regions (e.g. vowels, nasals, glides, etc.) and noise level which is optimized in terms of bias-variance trade-offs and statistical stationarity This approach also provides for multi-resolution speech recognition which uses noise suppression as a preprocessor.

As is also readily apparent, the present invention can be applied to speech signals to adaptively filter the noise and improve the quality of speech. A better quality service will result in improved satisfaction among cellular and Personal Communication System (PCS) customers. The present invention can also be used as a preprocessor in speech recognition for noisy speech. Moreover, the broad classification of the present invention can be used in a speech recognizer as a multi-resolution feature identification process.

While the present invention has been described in conjunction with wireless communication, those of ordinary skill in the art will recognize its utility in any application where noise suppression is desired. In that regard, it is to be understood that the present invention has been described in an illustrative manner and the terminology which has been used is intended to be in the nature of words of description rather than of limitation As previously stated, many modifications and variations of the present invention are possible in light of the above teachings. Therefore, it is also to be understood that within the scope of the following claims, the invention may be practiced otherwise than as specifically described.

We claim:

1. A method for adaptively filtering a speech signal, the method comprising:

dividing the signal into a plurality of frames, each frame having one of a plurality of sound types associated therewith;

determining one of a plurality of classes for each frame, wherein the class determined depends on the sound type associated with the frame;

selecting one of a plurality of filters for each frame, wherein the filter selected depends on the class of the frame;

filtering each frame according to the filter selected; and combining the plurality of filtered frames to provide a filtered speech signal.

2. The method of claim 1 further comprising estimating parameters for the plurality of filters based on a clean speech signal.

3. The method of claim 1 wherein each of the plurality of filters is associated with one of the plurality of classes for the frames.

4. The method of claim 1 wherein the plurality of filters comprises a filter bank.

5. The method of claim 1 wherein the speech signal is a time domain signal and each of the plurality of frames comprises a portion of the signal, each portion having a preselected time period.

6. The method of claim 1 wherein the speech signal is a time domain signal and each of the plurality of frames comprises a portion of the signal, each portion having a variable time period.

7. The method of claim 1 wherein the plurality of sound types comprises speech and non-speech sounds.

8. The method of claim 1 wherein the plurality of sound types comprises silence, fricatives, stops, vowels, nasals, and glides.

9. The method of claim 8 wherein the plurality of sound types further comprises other non-speech sounds.

10. A system for adaptively filtering a speech signal, the system comprising:

means for dividing the signal into a plurality of frames, each frame having one of a plurality of sound types associated therewith;

means for determining one of a plurality of classes for each frame, wherein the class determined depends on the sound type associated with the frame;

a plurality of filters for filtering the frames;

means for selecting one of the plurality of filters for each frame, wherein the filter selected depends upon the class of the frame; and means for combining the plurality of filtered frames to provide a filtered speech signal.

11. The system of claim 10 further comprising means for estimating parameters for the plurality of filters based on a clean speech signal.

12. The system of claim 10 wherein each of the plurality of filters is associated with one of the plurality of classes for the frames.

13. The system of claim 10 wherein the plurality of filters comprises a filter bank.

14. The system of claim 10 wherein the speech signal is a time domain signal and each of the plurality of frames comprises a portion of the signal, each portion having a preselected time period.

15. The system of claim 10 wherein the speech signal is a time domain signal and each of the plurality of frames comprises a portion of the signal, each portion having a variable time period.

16. The system of claim 10 wherein the plurality of sound types comprises speech and non-speech sounds.

17. The system of claim 10 wherein the plurality of sound types comprises silence, fricatives, stops, vowels, nasals, and glides.

18. The system of claim 17 wherein the plurality of sound types further comprises other non-speech sounds.

* * * * *

UNITED STATES PATENT AND TRADEMARK OFFICE

CERTIFICATE OF CORRECTION

PATENT NO. 5,963,899

DATED October 5, 1999

INVENTOR(S) Aruna Bayya and Marvin L. Vis

It is certified that error appears in the above-identified patent and that said Letters Patent is hereby corrected as shown below:

In column 7, line 40: after "stationarity" insert --,--
In column 7, line 61: after "limitation" insert --,--

Signed and Sealed this

Twenty-third Day of May, 2000

*Attest:*

Q. TODD DICKINSON

*Attesting Officer*

*Director of Patents and Trademarks*